US006135343A

United States Patent [19]

Thörngren et al.

[11] Patent Number: 6,135,343

[45] Date of Patent: Oct. 24, 2000

[54] METHOD FOR ROLL FORMING AND MACHINE AND BLANK FOR THIS

[75] Inventors: Jan Thörngren, Edsbruk; Herman Thuswaldner, Gamleby, both of Sweden

[73] Assignee: AB Ribea Engineering, Sweden

[21] Appl. No.: 09/194,096

[22] PCT Filed: May 21, 1997

[86] PCT No.: PCT/SE97/00823

§ 371 Date: Nov. 20, 1998

§ 102(e) Date: Nov. 20, 1998

[87] PCT Pub. No.: WO97/45215

PCT Pub. Date: Dec. 4, 1997

[30] Foreign Application Priority Data

May 24, 1996 [SE] Sweden ..... 9601977

[51] Int. Cl.[7] ..... B21D 21/00

[52] U.S. Cl. ..... 228/141.1; 228/145; 228/158; 228/152; 228/173.1

[58] Field of Search ..... 228/141.1, 145, 228/158, 152, 173.1, 173.2, 175, 178, 182, 17, 17.7, 15.1; 72/169; 428/595

[56] References Cited

U.S. PATENT DOCUMENTS

| | | | |
|---|---|---|---|
| 1,926,320 | 9/1933 | Trembour | 29/189 |
| 2,362,657 | 11/1944 | Meyer | 113/120 |
| 3,016,082 | 1/1962 | Miller | 153/54 |
| 3,091,279 | 5/1963 | O'Neill | 153/60 |
| 3,287,953 | 11/1966 | Boldrini | 72/171 |
| 3,623,349 | 11/1971 | Hausler | 72/169 |
| 3,715,557 | 2/1973 | Netterstedt et al. | 219/62 |
| 3,768,292 | 10/1973 | Tsuru | 72/169 |
| 4,195,509 | 4/1980 | Herburg | 72/167 |
| 4,205,546 | 6/1980 | Lagasse et al. | 72/347 |
| 4,476,194 | 10/1984 | Sanborn et al. | 428/585 |
| 4,491,004 | 1/1985 | Ivanoff | 72/168 |
| 4,735,076 | 4/1988 | Zeugin et al. | 72/307 |

FOREIGN PATENT DOCUMENTS

| | | | |
|---|---|---|---|
| WO 95/10371 | 4/1995 | WIPO | B21D 5/14 |

*Primary Examiner*—Patrick Ryan
*Assistant Examiner*—M. Alexandra Elve
*Attorney, Agent, or Firm*—Hayes, Soloway, Hennessey, Grossman & Hage, P.C.

[57] ABSTRACT

Method for the fabrication of cones of sheet material where the blank includes two curved edges that are circular and have the radius R and r respectively and a common center C. The blank further has two straight lateral edges which are angled in relation to the circular edges. An angle α between the radius, through a corner and a first straight edge is as great as an angle β between the radius through a second straight edge. A frustum of a cone is obtained from the blank after rolling the cone such that the lateral edges have been united to make a joint that runs helically around the cone.

12 Claims, 5 Drawing Sheets

Figure 1:
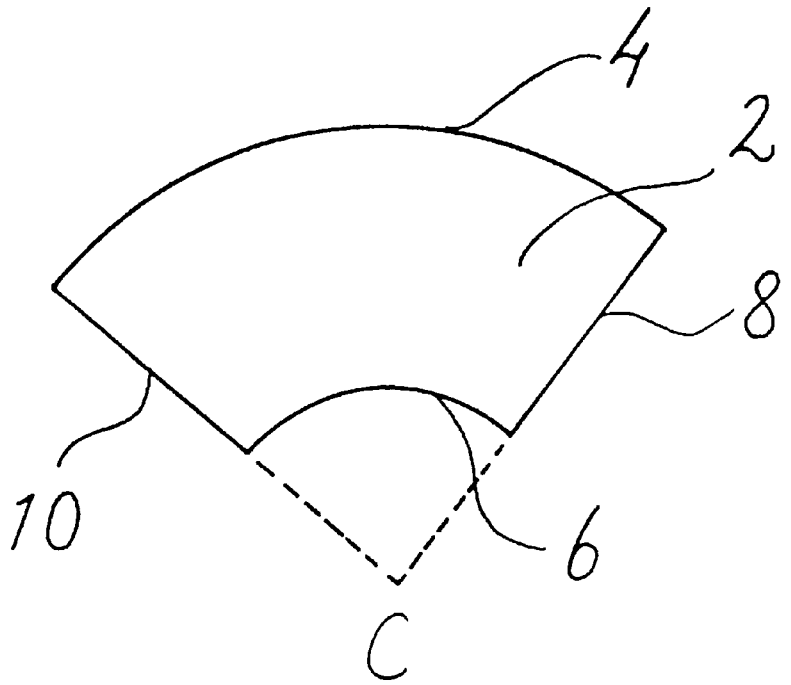

Fig. 9
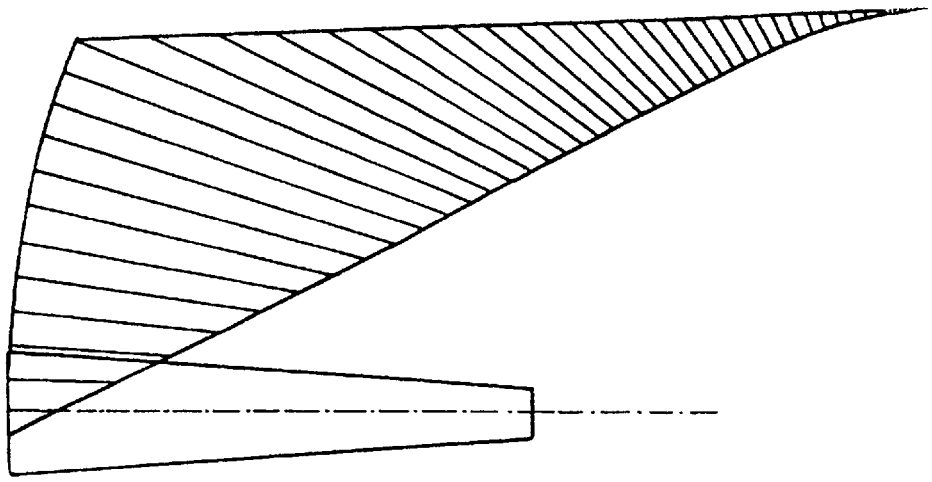
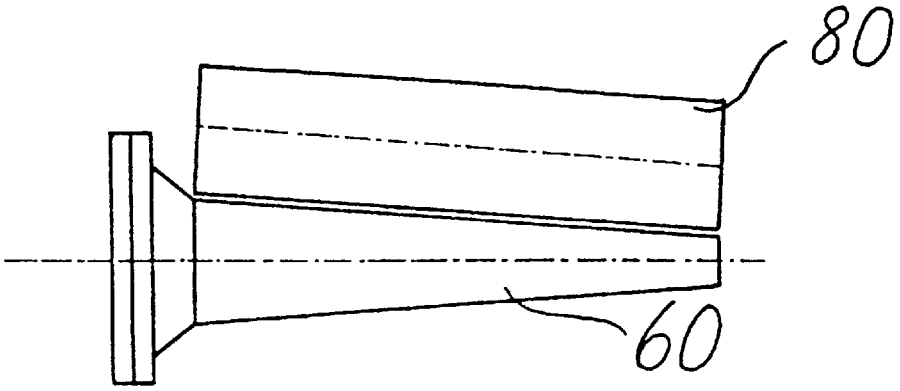
Fig. 8

METHOD FOR ROLL FORMING AND MACHINE AND BLANK FOR THIS

This invention concerns a method and a machine for the fabrication of a conical mantle of sheet material, in particular a frustrum of a cone intended to be press rolled further to final shape. The invention also concerns the starting blank of the cone. According to the invention made cones may with advantage be used at the fabrication of water cyclones intended for the cleaning of waste water as well as fibre suspensions in paper mills.

According to previously known technique fabrication of conical mantles made from sheet material starts with the milling of ring shaped sheet segments so that they take conical shape. Examples of this are described in the U.S. Pat. Nos. 3,016,082, 3,091,279, 3,287,953, 3,623,349, 4,195,509 and 4,735,076. At the rolling according to the known technique three or four rollers are used and the sheet blank is subjected to more forceful deformation in its more narrow, the upper end of the cone corresponding end and its rolled so that the opposing radial sides of the ring segment meet, whereafter these are joined together.

It is also known to fabricate cones by in a number of operations pressing a blank so that it finally receives a conical shap. Since however this method includes many steps it is practically impossible to guarantee an entirely round shape. At the use of cones made in this way for the fabrication of for instance cones in cyclones by subsequent press rolling a part of this unroundness will remain. In particular the unroundness that is a result of the weld often remain.

It has in reality turned out to be difficult or perhaps even impossible to secure that the cross section of the cone becomes round. Generally the radius in the area close to the edges that are to be joined become somewhat longer than intended, i.e. it is difficult to make the curving to continue all the way to the edge. Furthermore the forces necessary for the shaping closest to the edge increase to very high values. In reality thus the edges that are to be joined will remain entirely flat. This phenomenon results in turn in that a corner is accrued in the cone. If the cone is to be used at the fabrication of a cyclone, vortex cleaner or the like such a corner noticeable diminish the separating ability of the cleaner by turbulence being generated at the corner or corners. Furthermore an unround cone is worn faster in a cyclone. If one attempts to apply larger forces in order to achieve a counteracting of this tendency there is a risk that an indentation take place instead. This also result in turbulence and unsatisfactory separation and great wear. Also when a cone made in this way is machined additionally by for instance press rolling normally the tendency for unroundness remain in the final product.

The risk for unroundness in the final product is not only a result of the rolling itself but may also be result of welding. The welding heat namely result in a tendency to bend the sheet material in the edge area. Since a weld furthermore always has a tendency to shorten somewhat when it has cooled off one risks not only to obtain unroundness but also a bending of the cone in its length direction.

Of the above mentioned methods for the fabrication of cones the rolling method has the drawback that the blank will be too flat close to the joint to give a good roundness at the welding while the successive pressing in tools although giving greater possibility to counteract this, simultaneously easily result in a great number of corners for the cone corresponding to the joints between the different bending steps. The latter method also has the drawback with great tooling costs and many steps in the work. The known method result in circumstantial fabrication, large cassation risk and an expensive final product.

At the shaping the blank often passes through two or more bending or rolling phases. In the first the sheet is bent to a certain extent so that the final product from the second phase will be as close as possible to the conical shape. The cone is then removed from the bending station and transferred to a joining station in the shape of a welding automat. In particular at fabrication through bending in tools the number of work steps may be considerable.

In view of the above problems the invention has as its object to define a fabrication method, a machine and a blank for the making of cones, and then in particular frustrums of cones that can than be used as a starting blanks at pressure rolling to final shape. This object is in accordance with inventions solved by the joint (weld) that joins the edges of the sheet blank to each other being arranged helically around the cone. This gives however a long joint and thereby weld and thereby seemingly an increased risk of unroundness for the final cone. However in reality a considerably far better roundness is achieved than at the known methods. This depends on the required shaping not taking place in parallel with the edges of the joint as in the known method but at angle to the this. As a result of this the bending of the blank to its conical shape will continue all the way out to the edges when joining is to take place. In addition to resulting in an improved roundness at the joint after the welding this also result in smaller shaping forces than at the known methods and furthermore the shaping forces are more uniform during the entire shaping.

The blank is at rolling in accordance with the invention controlled so that it turns around tip of the cone in order to place lateral, for joining intended edges correctly next to each other. The gripping and control of the blank in relation to shaping tools can preferably take place by the blank being gripped and or controlled so that the circular part of the blank that is to constitute the base edge of the cone follows a circle path, the radius of which equals the radius of the corresponding part circle edge of the blank and that the same relationship applies for the other circle segment shaped edge. Possibly the shaped base edge may be guided along a circle corresponding to the base edge of the cone, while for the part of the blank that has not yet been shaped the blank is guided so that its the upper edge of the cone constituting circle segment follows a circle with a corresponding diameter, preferably in a plane tangential to the cone to be.

An additional advantage with the invented fabrication method is that the welding together of the blank to a cone partly can take place simultaneously with the shaping. As soon as two edges of the blanks has come to lie close to each other the welding together of the joint established in this way can start simultaneously as the remaining part of the cone is shaped. The welding is then ended somewhat after the ending of the shaping itself. It is in other words possible to make a ready cone directly from the starting blank without the cone having to be transferred between different machines and work stations. This means a saving in time and money.

In order to enable welding simultaneously with the shaping of the blank to a cone the blank may not be held too close to the joint itself but this is preferably done a short distance from this during shaping. Possibly a blank can be provided with projecting tabs that later can be cut away.

When the rolling method according to the invention is used to make blanks that are then to be roll shaped to their final shape it is usual to weld a disc to the narrow end of the conical blank so that the blank can be held with this disc that is clamped axially. In accordance with a further development of the inventive thought one may however consider making the conical blank somewhat longer in its narrow end and that this end at the mounting before the pressure rolling is deformed between oppositely situated coglike or toothed elements so that a crown-like shape is obtained, achieving an axial holding of the blanc as well as a good torque transfer.

By choosing the rolling direction at a subsequent pressure rolling on the blank the rolling can take place against or in the direction of the helix. Since the joint helix possibly has a different composition or at least when worked can behave somewhat different than the remaining material there is the risk that the joint in particular becomes to short and consequently tries to follow a smaller diameter all the way than the remaining ready cone. This can be counteracted by an opposed pressure rolling against the helix, that is the cone turns during working in a direction corresponding to a shortening of the joint so that the tendency of the joint to become to short is counteracted. Possibly the roundness may be controlled more accurately by effecting rolling in alternating directions until desired roundness is achieved, possibly a continuous monitoring with repeated alternating of the rotational direction can take place to secure that the desired roundness during the entire working time is maintained and in particular is present at the same time as a cone is through with the pressure rolling.

In order to make it possible for the welding to take place in an entirely horizontal joint also the entire machine used or only its rolling parts may be turnable or tilltable in order for an adaption to different cone angles.

The method, the machine and the blanks in accordance with the invention provides a rapid fabrication of ready cones as well as conical blanks for continued working with exactness and a low tooling cost. For instance the machine may include a shaping mandrel on which the blank is rolled up. At this only one corresponding shaping mandrel must be made for each cone angle. Since the shaping mandrel may be fabricated by turning the price will furthermore be comparatively reasonable, this in particular in relation to the method with pressing the blank to its final shape in a number of steps and with dollies and dies.

Even if one as filler material for the weld joint uses thread or strips made from the same sheet metal as the blank one must calculate with the high temperature at the welding resulting in a variation in the material composition that in turn result in a somewhat differing behavior at the subsequent rolling.

Figure 5:
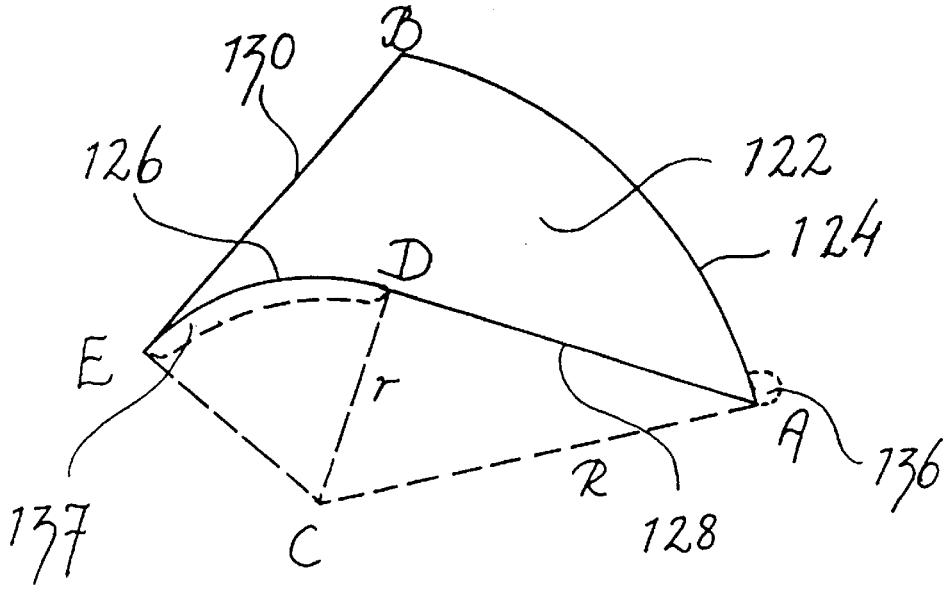
Figure 6:
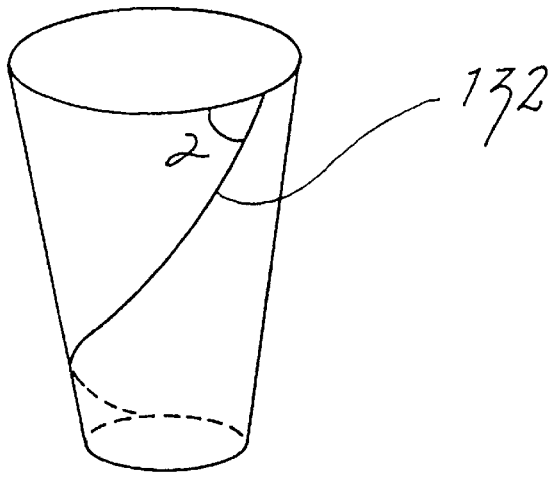
Figure 7:
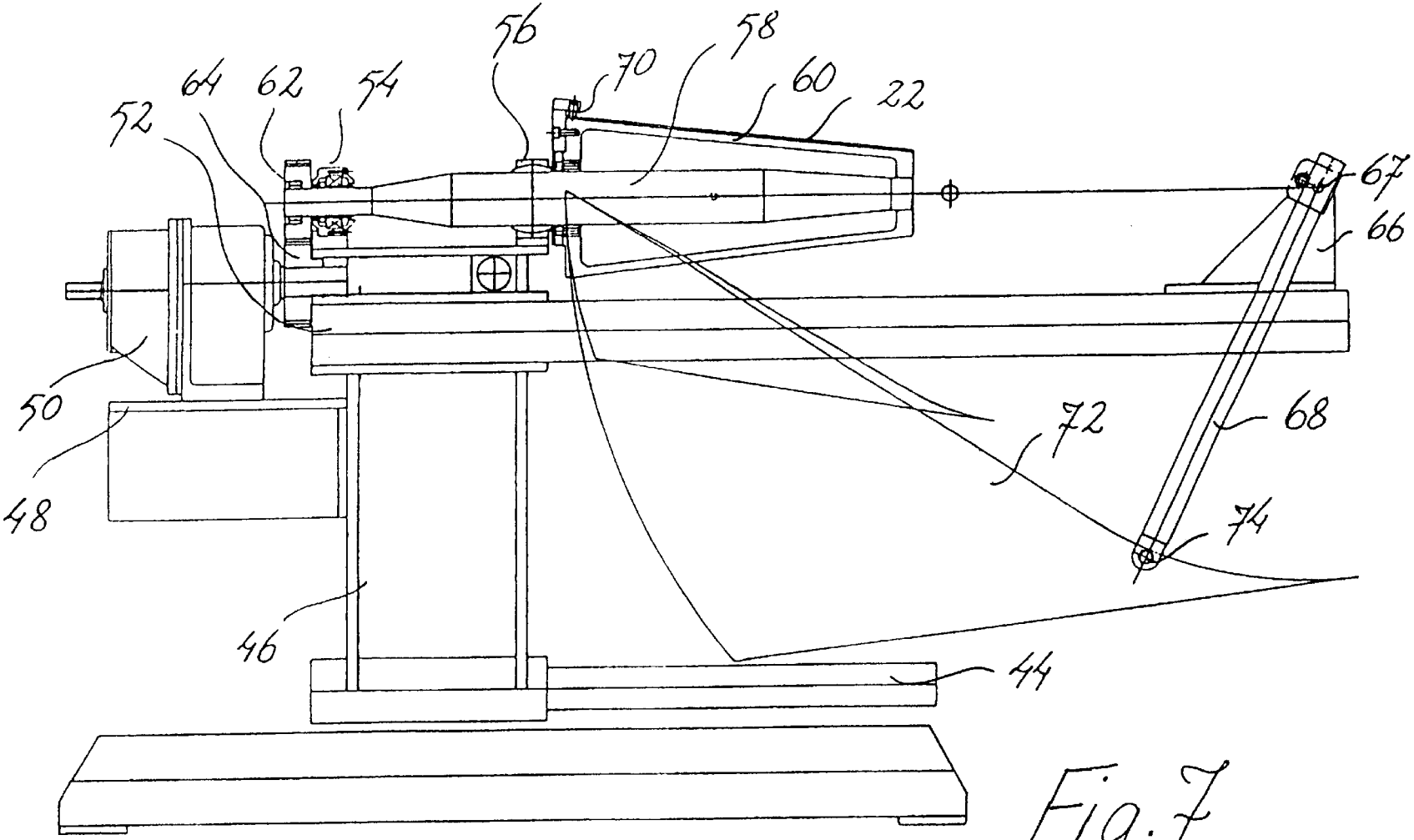

Further advantages and characteristics of the invention are apparent from the patent claims and from the following description of preferred embodiments of invention, shown in the drawings. In the drawings FIG. 1 shows a blank according to previously known technique, FIG. 2 a corresponding cone, FIG. 3 a blank according to the first preferred embodiment of the invention, FIG. 4 shows a cone made from the blank in FIG. 3, FIG. 5 shows a second preferred blank in accordance with the invention, FIG. 6 a cone made of the blank in FIG. 5, FIG. 7 shows a machine for the execution of the method in accordance with the invention, FIG. 8 shows a detail the machine in FIG. 7 and FIG. 9 a cone blank.

Figure 2:
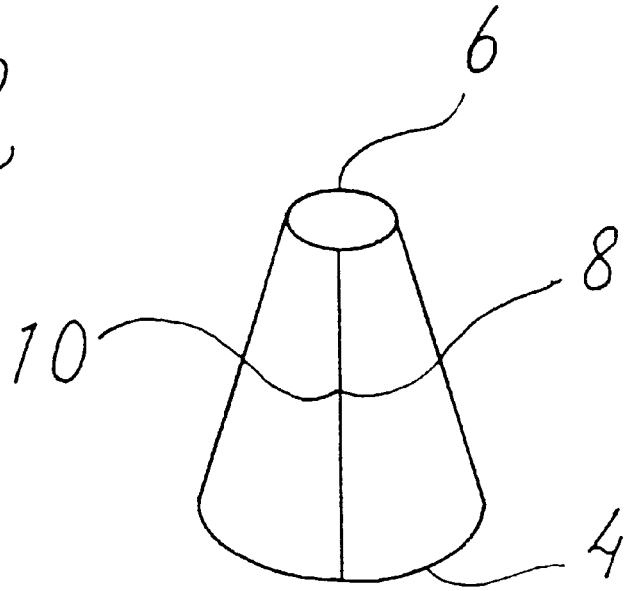

In FIG. 1 is shown a flat sheet blank 2 made by two circular edges 4 and 6 with a common center C. The blank 2 constituting a segment has also two apposed straight radially running side edges 8 and 10 the extensions of which intersect in the center C of the circle. In FIG. 2 is shown how the blank 2 in FIG. 1 has been rolled to a frustrum of a cone so that the lateral edges 8 and 9 of the blank lies neighboring to each other and have been joined together there.

Figure 3:
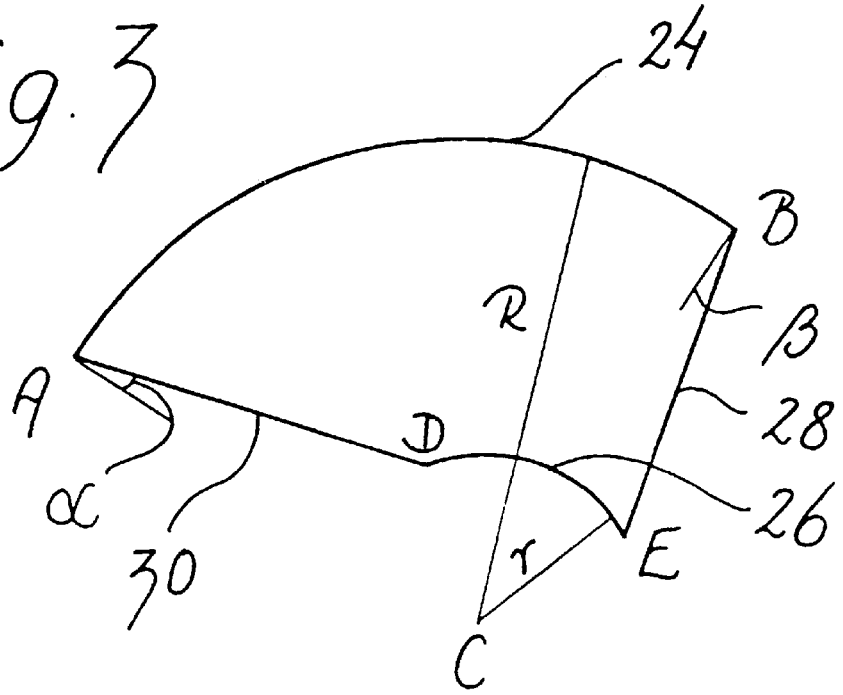

FIG. 3 shows a blank in accordance with a first preferred embodiment of the invention. The blank 22 includes two curved edges 24 and 26 that are circular and have the radiuses R and r respectively and a common center C. The blank furthermore has two straight lateral edges 28 and 30, which instead of being arranged radially are arranged angled in relation to the radial direction. An angle a between the radius through the corner A and the edge 30 and an angle β between the radius through the comer B and the edge 28, which angles are equal.

Figure 4:
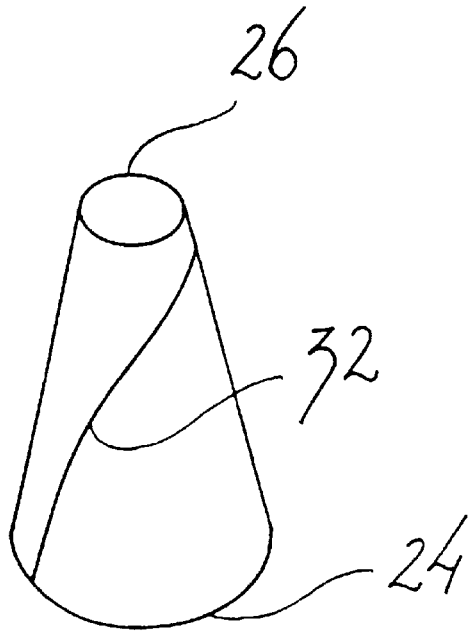

In FIG. 4 the frustrum of a cone is shown that is obtained from the blank in FIG. 3 after the rolling of this to a cone were the lateral edges 28 and 30 has been joined to make a joint 32 that runs helically around the cone.

In FIG. 5 is shown an alternative embodiment of blank in accordance with the invention. Also this blank is constituted by two curved edges 124 and 126 that are parts of separate circles and the lateral edges 128 and 130. In relation to the previously shown embodiment the lateral edges 128 and 130 are arranged tangential in relation to the inner edge 126. In FIG. 6 is then shown how the lateral edges 128 and 130 joined together to a joint 132 encloses an angle γ with a plane perpendicular to the axis of the cone at the wider end of the cone and how this angle is reduced towards the thinner end of the cone.

In order to secure that the circles that constitutes the upper and lower ends of the frustrum of a cone are perpendicular to the axis of the cone the curved edges of the blank must constitute parts of circles with a common center for the curvature. At the rolling it is preferable that the rolling axis goes through this center. Furthermore the lateral edges must have the same length and shape if a cone with straight sides are to be achieved. The lateral edges need not necessarily to be straight but may also be curved or shaped in some other way to grip into each other, but to establish a good joint they must have a coinciding shape. FIG. 9 can be said to show a blank that has been bent back to flat condition after the drawing of a number of generatrixes in the cone. As is apparent the lines are perpendicular relative the curved edge 224 as well as the curved edge 226, that is the ends of the cone.

The above described blanks are not practical to use for the fabrication of cones that become more and more pointed or even include their actual tip, since the blank would become very thin close to the tip and the welding length would become very large close to this. If therefor a pointed cone is desired one can consider the joint to be arranged with helical shape to a certain level in the cone whereafter it runs essentially along a generatrix. The transit may course be smooth.

The arrangement of a fixation tab extending downwards of the cone itself also has the advantage that the corner first rolled of the cone can be shaped all the way from the tip. This has in dashed lines been shown in FIG. 5 and been denoted 136, in the same figure it has also been shown in dashed lines how the cone may be extended upwards with one or several tabs 137 to establish the fixation at the following pressure rolling.

Since it may be difficult satisfactory to join together the outermost tip of the blank with the remaining already fabricated part of the cone it may even from this reason be advantageous to allow the blank in this area to be somewhat too large, which part then at a suitable opportunity can be cut away when the cone is ready or before this be used for the holding at the pressure rolling.

The above described blanks may be shaped in different ways to their conical form but preferably this takes place in a rolling or milling process enabling an entirely continuous shaping in one step to final form. Due to the helical shape the bending that is required will be comparably moderate and the bending may therefor take place to fmal dimensions in one step. The shaping may be achieve by means of three rolls in a known manner or by rolling the blank on a core or mandrel.

The machine shown in FIG. 7 for cone fabrication includes a shaping mandrel constituted by a lining 60 arranged on an axle 58. The axle 58 is journaled in two roll bearings 54 and 56 and can be turned around by a two pinions 62, 64 and transmission 50 driving the latter of these pinions connected to a not shown power source. When cones with an other angle or other diameters are fabricated the lining may be exchanged alternatively one can consider to exchange the entire shaping mandrel including lining as well as axle and pinion 62 and possibly also the bearings.

The shaping mandrel 60 is at its base end provided with a bridge like part that has been denoted 70, in which a lip extends out over the conical surface of the mandrel and in this lip is a threaded a bolt that is intended for the holding of the blank 72. Parallel to the rotational axis of the shaping mandrel a beam 52 is arranged shortly below the shaping mandrel. On this beam 52 is fastened a console 66 that via a ball joint 67 carries an arm 68. The arm 68 is in its outer end provided with a fork like part were a bolt 74 is threaded for the clamping of the blank 72. A console 66 is displaceably and fixably arranged on the beam 52 to enable adjustment so that it is placed exactly in the center of the theoretical extension of the generatrixes of the shaping mandrel.

On a lower down in the machine in a frame arranged additional beam 44, that runs entirely parallel to the axis of the shaping mandrel, an arm is arranged displaceable and pivotably supporting the pressure roll 80 shown in FIG. 2. The arm is preferably displaceable lengthwise of the machine and adjustable to its turning angle so that the pressure roll can be placed parallel with the side of the shaping mandrel and can further more be swung or displaced latterly in accordance with the thickness of the sheet from which the cone is to be made. The pressure roll is divided into a number of short rolls or rings arranged close to each other and relative each other freely tumable for adaption to the peripheral speed of the shaping mandrel and blank, which peripheral speed varies over the length due to the diameter variation.

At the fabrication of a sheet material cone, for instance for the fabrication of a blank that is then to be rolled to its final shapes, the blank 72 is fastened to the shaping roll 60 by the lip 70 being swung down to lie entirely horizontally in relation to the axis of the mandrel. The blank 72 is placed parallel to the lateral surface of the mandrel so that the blank principally lies tangentially in relation to the mandrel. The blank is clamped a distance from the corner, this in order to make it possible for the not shown welding device to weld the joint all the way from the base of the cone. Furthermore the fork like end of the arm 68 is with the bolt 74 fastened in the blank in the curved portion of the blank that is to constitute the thinner end of the cone. The blank 72 extends up between the shaping mandrel 60 and the pressure roll 80 (FIG. 8). The mandrel is now brought to turn and at this pulls the blank 72 upwards. The pressure roll presses the blank against the mandrel and the blank is shaped after the mandrel. Since the shaping starts in the wider end of the mandrel the initial deformation will not be so forceful, instead the necessary forces that are required will be comparably moderate, in particular in comparison with conventual shaping. As the mandrel successively rolls up more and more of the blank this moves upwards during a simultaneous turning of the arm 68 around its journaling point in the console 66. In this way the blank is positively controlled by the fastening 70 on the mandrel and fastening 74 at the arm. At none of these places any relative movement have to take place since the fastening is arranged in relation to the blank in the same manor at it also will be located when the shaping is ended. When the mandrel has rotated an entire revolution the entire base edge of the cone has been achieved and the lowermost edge of the blank 72 is placed close to the first running on and uppermost edge. When then the joint after an additional quarter of a revolution reaches the uppermost position during the rotation of the mandrel the welding of the joint is commenced by a not shown automatic welding device. During the continued turning of the mandrel and thereby continued establishing of the joint also the welding continues, still exactly above the axis of the mandrel in the length direction of this. The control of the welding can be electronic, optical, mechanical or combinations thereof.

In order to secure optimal welding conditions the machine is preferably tiltable, for instance turnable around the axis 73 in order to secure that welding always takes place in an entirely horizontal joint. If one would wish to move the location of the welding closer to the press roller one can consider a turning up of this or a higher placing, which may be achieved by turning the machine around a longitudinal axis that may for instance be constituted by the beam 52.

The arm 68 can either be made free from the blank 72 when the welding operation has been started and thereby the cone in making and the blank can not move not any more even if freed from the arm. Alternatively the arm can remain during the entire operation if the cone is longer than the shaping mandrel or if at the shaping mandrel is arranged a corresponding recess for the end of the arm.

The fastening means 70 and 74 for the holding of the blank may also be constituted by manually, hydraulically, pneumatically, or electrically activated quick coupling means.

In order to supply protective gas as well as to prevent too much cooling from below of the weld a helical recess may be arranged corresponding to the helix of the joint in the mantle surface of the shaping mandrel. The arm 68 is adjustable to its length for adaption to the amount of the intended cone that is to be cut away at the fabrication of the intended frustrum of a cone as well as to the making of different cones.

The above described fabrication method with an arm as the guide may also be used at a rolling method with three rolls. In order here to secure that the lower edge of the cone the entire time is held in the correct position one may either arrange a corresponding turnable guiding that rotates around the theoretical axle of symmetry of the cone and to which the blank of the cone is fastened with the first rolled corner.

Instead of controlling the blank during its rolling up on a mandrel by means of the above described arm one can consider that the blank with its outer circular edge that is to constitute the base edge of the cone is allowed to lie against a radial flange on the mandrel. The flange may possibly be provided with a circular groove into which the base edge of the cone during the shaping successively is swung into. Since the blank is drawn past the press roll achieving the deformation there will all the time exist a force that holds the blank pressed against the radial flange.

Instead of holding the blank in the base part of cone with a clamping bolt one can consider a pin gripping into a hole in the blank or that the blank is extended with a hook like part that its hooked over a pin or the like.

What is claimed is:

1. Method for the fabrication of a cone or a part thereof by rolling and welding of sheet material, in particular frustum of a cone, in particular intended as a starting blank at press rolling of cones intended for cyclones, characterized in that the joint is arranged helically.

2. Method according to claim 1, characterized in that the blank at the shaping to a cone is positively guided at at least two fixations points, in such a way that the movement center of the blank during the shaping is positively controlled to coincide with the tip of the cone.

3. Method according to claim 2 for the fabrication of frustum of cones, characterized in that the lower base edge of the cone is positively guided to the circle that it is to constitute.

4. Method according to claim 1, characterized in that the joint is welded simultaneously with continued rolling of the blank.

5. Method according to claim 1, characterized in that the fabrication of the cone is ended with a press rolling of this between a mandrel and a press roller, the turning direction being so arranged that the turning angle of the helical joint at the plastic deformation tends to diminish.

6. Machine for the execution of the method in accordance with claim 1, characterized in that it includes a conical shaping roller, a press roller that can be pressed against this, and a fastening means for holding of the blank at the holding mandrel, in particular its first rolled on corner.

7. Machine according to claim 6, characterized in that it includes an arm journaled pivotable in the tip of the mandrel respectively the tip of the cone in a plane that is tangent plane to the cone and that the arm in the other end is fastened to the blank and that the sum of the length of the arm and the length from the base edge of the blank to the fastening point and the arm in this along a generatrix of the final cone equals the length of a generatrix in the intended cone.

8. Machine according to claim 6, characterized in that the shaping roller is provided with a helical groove over which the welding of the joint is to take place.

9. Machine according to claim 6, characterized in that the machine is tiltable so that the weld may be arranged horizontally even at different cone angles.

10. Machine according to claim 6, characterized in that the shaping mandrel is exchangeable and that the turning center of the arm is displaceable along the center line of the cone for adaption to different cone sizes and cone angles.

11. Blank for the fabrication of frustum of cones of sheet material with helical joint, characterized in that it includes a first part of a circle with a large diameter and a length corresponding to the largest diameter of the frustum of a cone and a second border line that also constitutes a part of a circle intended to constitute the end of the cone with the smaller diameter, which circles have the same center and at which the length of the generatrix of the frustum of a cone equals the diameter difference between the two circles and that the blank is further limited by two edges each extending between the other ends of the circle parts and at which the angles between these side edges and the circle parts differs from 90°.

12. Blank according to claim 11, characterized in that the edges extending between the circle parts have the same shape and length.

* * * * *